US007863883B2

(12) United States Patent
Jurasek et al.

(10) Patent No.: US 7,863,883 B2
(45) Date of Patent: Jan. 4, 2011

(54) LOW-VOLTAGE CURRENT REFERENCE AND METHOD THEREOF

(75) Inventors: Ryan Andrew Jurasek, S. Burlington, VT (US); Bret Roberts Dale, Jericho, VT (US); Darin James Daudelin, Williston, VT (US); Dave Eugene Chapmen, Shelburne, VT (US)

(73) Assignee: Nanya Technology Corp., Kueishan, Tao-Yuan Hsien (TW)

( * ) Notice: Subject to any disclaimer, the term of this patent is extended or adjusted under 35 U.S.C. 154(b) by 363 days.

(21) Appl. No.: 12/105,276

(22) Filed: Apr. 18, 2008

(65) Prior Publication Data

US 2009/0261801 A1 Oct. 22, 2009

(51) Int. Cl.
*G05F 3/16* (2006.01)
*G05F 3/20* (2006.01)

(52) U.S. Cl. ..... 323/313; 323/901; 323/312

(58) Field of Classification Search ..... 323/311–317, 323/901; 327/539
See application file for complete search history.

(56) References Cited

U.S. PATENT DOCUMENTS 6,191,646 B1 * 2/2001 Shin ..... 327/543
2006/0279270 A1 * 12/2006 Chen et al. ..... 323/313
2008/0018319 A1 * 1/2008 Chang et al. ..... 323/315

OTHER PUBLICATIONS

Banba et al; A CMOS Bandgap Reference Circuit with Sub-1-V Operation; May 1999; IEEE Journal of Solid-State Circuits; vol. 34; No. 5; pp. 670-674.*

* cited by examiner

*Primary Examiner*—Harry Behm
*Assistant Examiner*—M. G.
(74) *Attorney, Agent, or Firm*—Winston Hsu; Scott Margo

(57) ABSTRACT

A low-voltage current reference providing a current being substantially constant with temperature includes a low voltage bandgap, a start circuit coupled to the low voltage bandgap, and a current summer coupled to the low voltage bandgap and to the start circuit. The low voltage bandgap is for providing a constant voltage reference, and the start circuit is for starting the low voltage bandgap from a non-start mode and for providing a proportional to absolute temperature (PTAT) current reference. The current summer is for providing a constant current reference according to the constant voltage reference and the PTAT current reference.

10 Claims, 5 Drawing Sheets

LOW-VOLTAGE CURRENT REFERENCE AND METHOD THEREOF

BACKGROUND OF THE INVENTION

1. Field of the Invention

The present invention relates to a low-voltage current reference, and more particularly, a low-voltage current reference providing a current being substantially constant with temperature.

2. Description of the Prior Art

Prior power references—current references and voltage references, for example—are subject to variances with temperature, affecting the performance of the circuits being powered by them. Many timers and other high-accuracy circuits and chips, however, require current references that are insensitive to fluctuations in temperature.

A bandgap reference is a common analog circuit used as a stable voltage reference for low-voltage circuits. In normal practice, as shown in FIG. 1 according to related art, a standard bandgap 140 can be used to produce a current that is proportional to absolute temperature (PTAT) Iptat. Another a low voltage bandgap 120 is used to produce a constant voltage that yields a complementary to absolute temperature (CTAT) current Icmnres when applied over a resistor in the current summer. When the ratio between the PTAT and CTAT currents (Iptat and Icmnres) are chosen properly and combined, the significant effects of the temperature dependency cancel out, resulting in a current Iconst that is effectively temperature insensitive. The current from the PTAT current bandgap is combined with the Icmnres current (in the current summer 130), to create a resultant current that is constant with temperature (CWT) Iconst.

There are, however, a number of problems and inconveniences from the above. The bandgaps 120 and 140 take up significant real estate on a circuit, and consume considerable power themselves. Additionally, each of the above bandgaps 120 and 140 requires a start circuit (115 and 110, respectively) to ensure they operate properly and in a timely fashion. These start circuits 115 and 110 occupy circuitry real estate and also consume power. From these issues, then, it becomes clear there remains room for improvement in the arena of temperature-insensitive current sources.

SUMMARY OF THE INVENTION

It is therefore an objective of the present invention to solve the aforementioned problems, and to provide a low-voltage current reference providing a current being constant with temperature while reducing the power and circuit area consumed by the low-voltage current reference.

In one embodiment of the present invention, a low-voltage current reference providing a current being substantially constant with temperature comprises a low voltage bandgap, a start circuit coupled to the low voltage bandgap, and a current summer coupled to the low voltage bandgap and to the start circuit. The low voltage bandgap is for providing a constant voltage reference to be applied across a resistor, and the start circuit is for starting the low voltage bandgap from a non-start mode and for providing a proportional to absolute temperature (PTAT) current reference. The current summer is for providing a constant current reference according to the CTAT current (e.g., Icmnres) and the PTAT current reference (e.g., Iptat).

In another embodiment of the present invention, a method for providing a low-voltage current reference being substantially constant with temperature comprises providing a constant voltage reference utilizing a low voltage bandgap, starting the low voltage bandgap from a non-start mode and providing a PTAT current reference by utilizing a start circuit coupled to the low voltage bandgap, and generating a constant current reference according to the constant voltage reference and the PTAT current reference by utilizing a current summer coupled to the low voltage bandgap and to the start circuit.

These and other problems are generally solved or circumvented, and technical advantages are generally achieved, by advantageous embodiments of the present invention, which include certain circuits and schematics of the components described within the disclosure of the present invention.

The foregoing has outlined rather broadly the features and technical advantages of the present invention in order that the detailed description of the invention that follows may be better understood. Additional features and descriptions of the present invention will be described hereinafter which form the subject of the claims of the present invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the preferred embodiments and are not necessarily drawn to scale.

DETAILED DESCRIPTION

Certain terms are used throughout the following description and claims to refer to particular system components. As one skilled in the art will appreciate, manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " The terms "coupled" and "couples" are intended to mean either an indirect or a direct electrical connection. Thus, if a first device couples to a second device, that connection may be through a direct electrical connection, or through an indirect electrical connection via other devices and connections.

As mentioned, an objective of the present invention is to provide a low-voltage current reference providing a current being substantially constant with temperature, while reducing the power and circuit area consumed by the low-voltage current reference.

Figure 2:
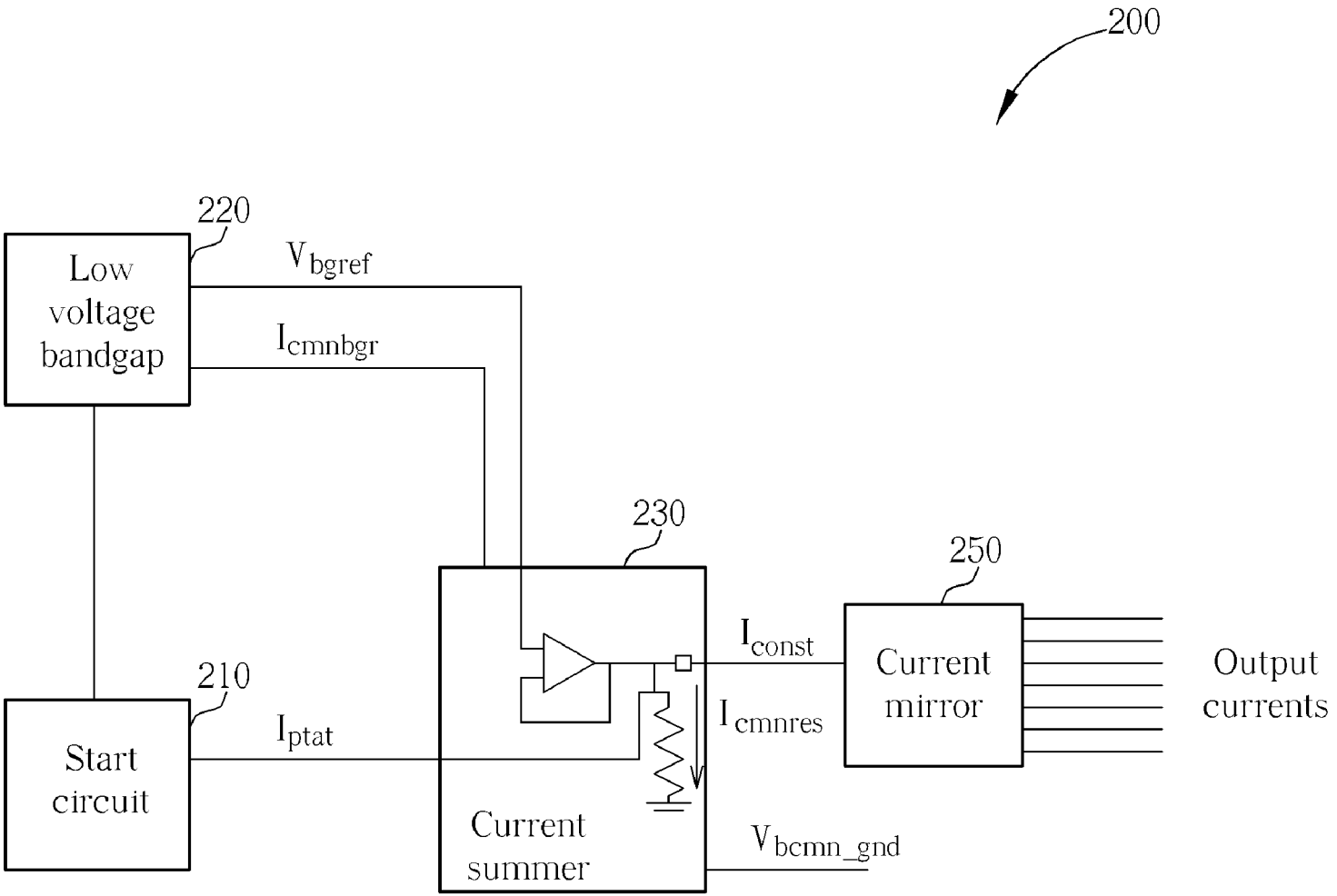
FIG. 2 is a block diagram of a low voltage current reference according to an embodiment of the present invention.

Please refer to FIG. 2, which is a block diagram of a low voltage current reference 200 according to an embodiment of the present invention.

Figure 1:
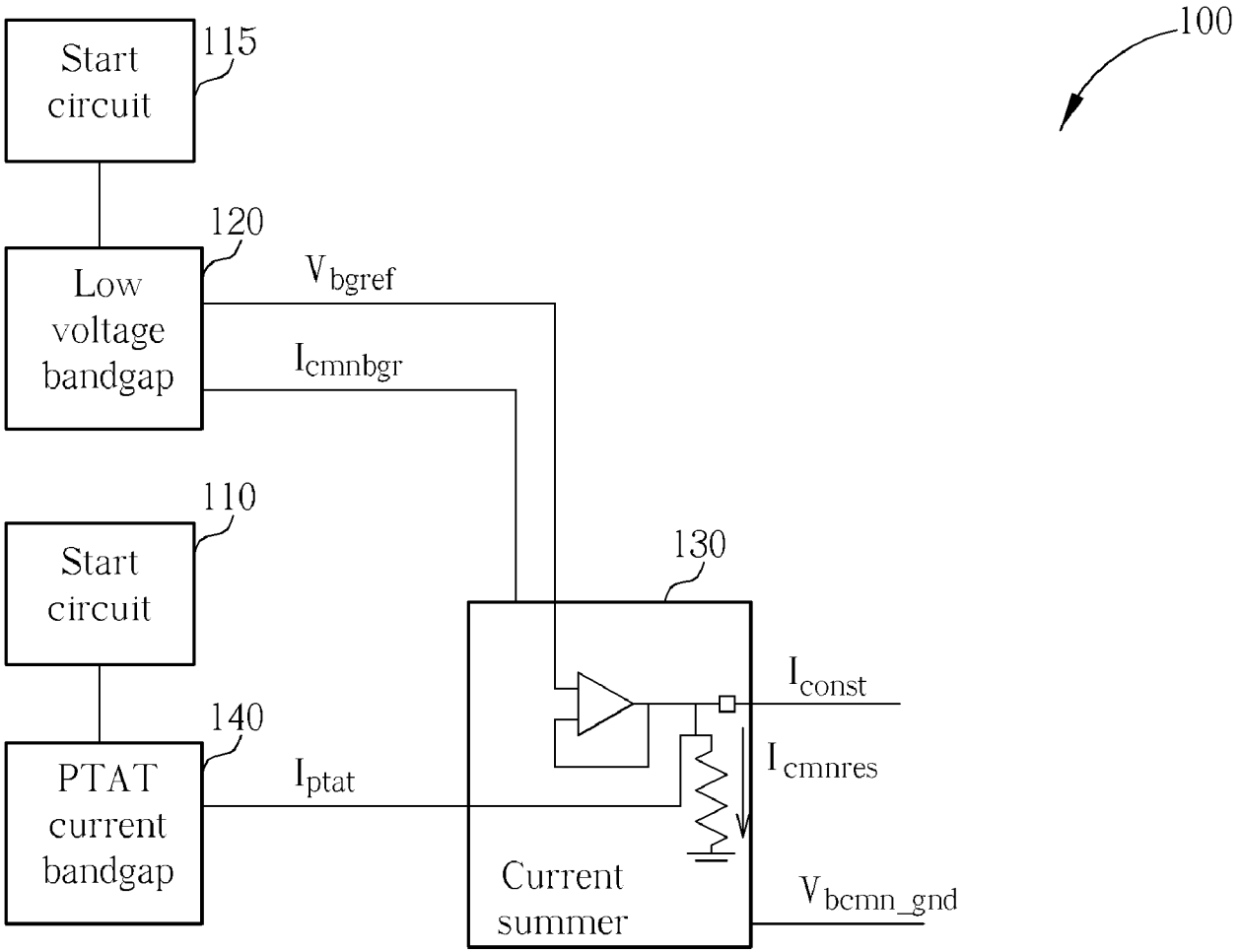
FIG. 1 RELATED ART
FIG. 1 is a block diagram of a low voltage current reference according to the related art.

The low voltage current reference 200 of FIG. 2 comprises a start circuit 210, a low voltage bandgap 220, and a current summer 230. As shown in FIG. 2, the low voltage bandgap 220 provides a constant voltage reference Vbgref; a current Icmnbgr is also provided mainly for powering the current summer 250. The start circuit 210 is coupled to the low voltage bandgap 220 for starting the low voltage bandgap 220 from a non-start mode. The single start circuit 210 in the low voltage current reference 200 of the present invention also provides a proportional to absolute temperature (PTAT) current reference Iptat to the current summer 230, eliminating the need of the prior arts to include (as shown in FIG. 1) a PTAT current bandgap 140 and a second start circuit 110. The current summer 230 is coupled to the low voltage bandgap 220 and to the start circuit 210, and provides a constant current reference Iconst according to the CTAT current Icmnres and the PTAT current reference Iptat. The constant current reference Iconst is constant with temperature.

FIG. 2 also depicts a current mirror 250 having an input coupled to the output of the current summer 230. The current mirror 250 mirrors the constant current reference Iconst to thereby provide a plurality of output currents to other components and circuits as desired. Please note that current mirror 250 is an optional component of the present invention that can be utilized according to different design requirements depending on how many output currents are required.

Figure 3:
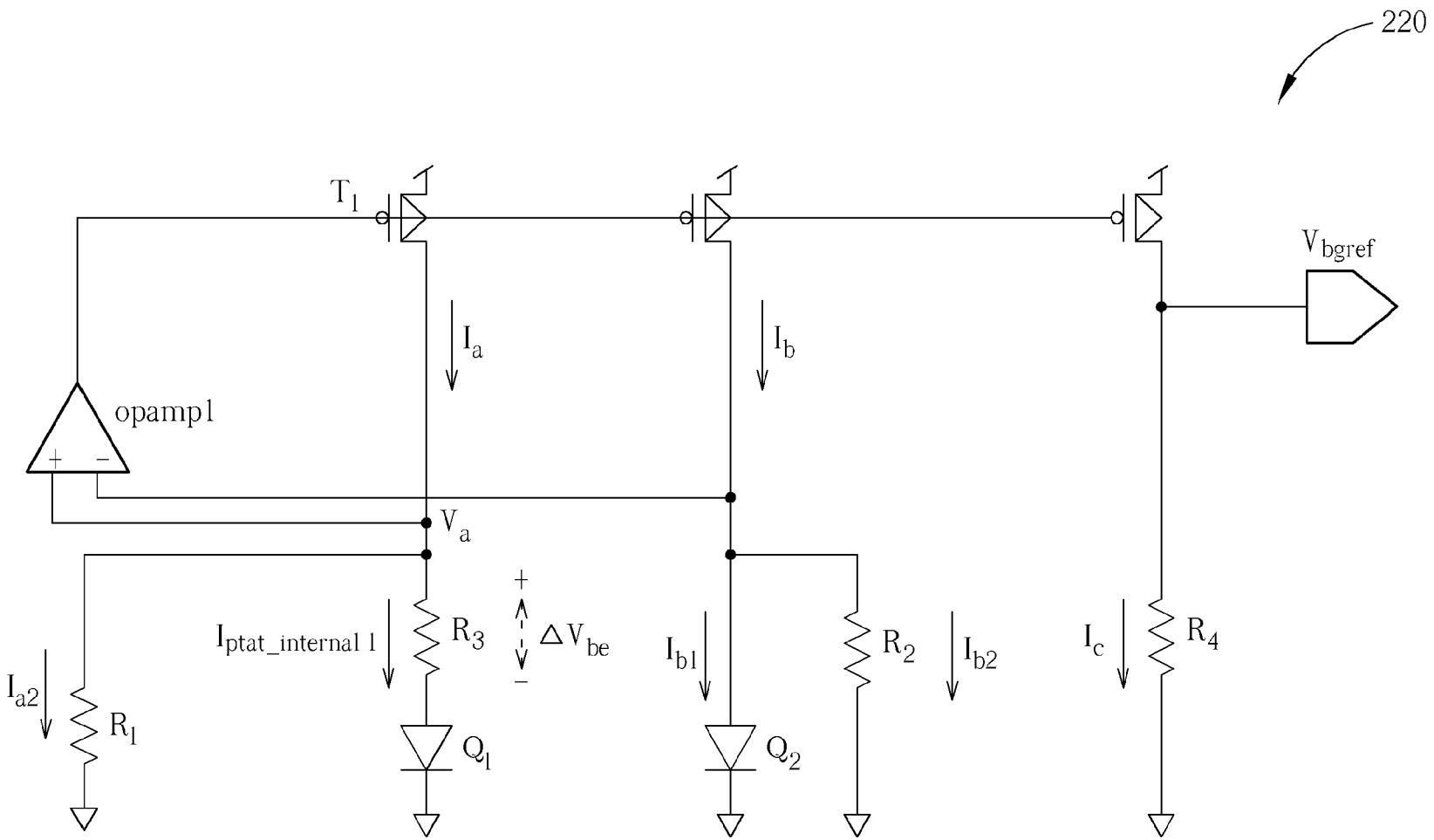
FIG. 3 is an exemplary schematic diagram of a low voltage bandgap circuit shown in FIG. 2 according to an embodiment of the present invention.

FIG. 3 shows an exemplary schematic diagram of the low voltage bandgap 220 shown in FIG. 2 according to an embodiment of the present invention. The exemplary low voltage bandgap 220 of FIG. 3 comprises a first operational amplifier (op amp) denoted opamp1, a first transistor T1, a first resistor R3, and a first diode Q1. The first op amp opamp1 has a positive input, a negative input, and an output. The first transistor T1 has a gate coupled to the output of the first op amp opamp1, and a source coupled to power. The first resistor R3 has one end coupled to the positive input of the first op amp opamp1 (shown in FIG. 3 at node Va) and to the drain of the first transistor T1. The anode of the first diode Q1 is coupled to the other end of the first resistor R3, and the cathode end of the first diode Q1 is coupled to ground. FIG. 3 also shows a third resistor R1 coupled between the first end of the first resistor R3 (at node Va) and ground.

Of particular note in FIG. 3 are the values of the first resistor R3, the first diode Q1, and the third resistor R1: their values can be selected such that the current flowing through the first resistor R3 and the first diode Q1 is a PTAT current (denoted as the first internal PTAT current Iptat_internal1). With the introduction of the third resistor R1 (acting as a mimic resistor diode), a replica current Ia2 flows through the third resistor R1. By utilizing the replica current Ia2, the first internal PTAT current Iptat_internal1 can be extracted from the low voltage bandgap 220 and can also be used in the start circuit 210, allowing this embodiment of the present invention to forgo a dedicated PTAT current bandgap 140 as needed in prior art. Further details will be clearer following a description of the start circuit 210 shown in FIG. 4.

Although the schematic diagram in FIG. 3 is presented comprising the first resistor R3, the first diode Q1, and the third resistor R1 in this example, the low voltage bandgap circuit 220 is an exemplary selection for illustration purposes only and is not intended as a limitation to the present invention. For instance, numerous other designs and implementations of a low voltage bandgap 220 are possible and should be considered within the scope of the present invention, as long as values of the first resistor R3, the first diode Q1, and the third resistor R1 can be selected to create the first internal PTAT current Iptat_internal1 flowing through the first resistor R3 and the first diode Q1. Please also note that the low voltage bandgap 220 shown in FIG. 3 also illustrates additional schematic components and circuit connections not central to the focus of the present invention, the operation and concepts of which should be clear to persons skilled in the art, and therefore are not detailed herein.

Figure 4:
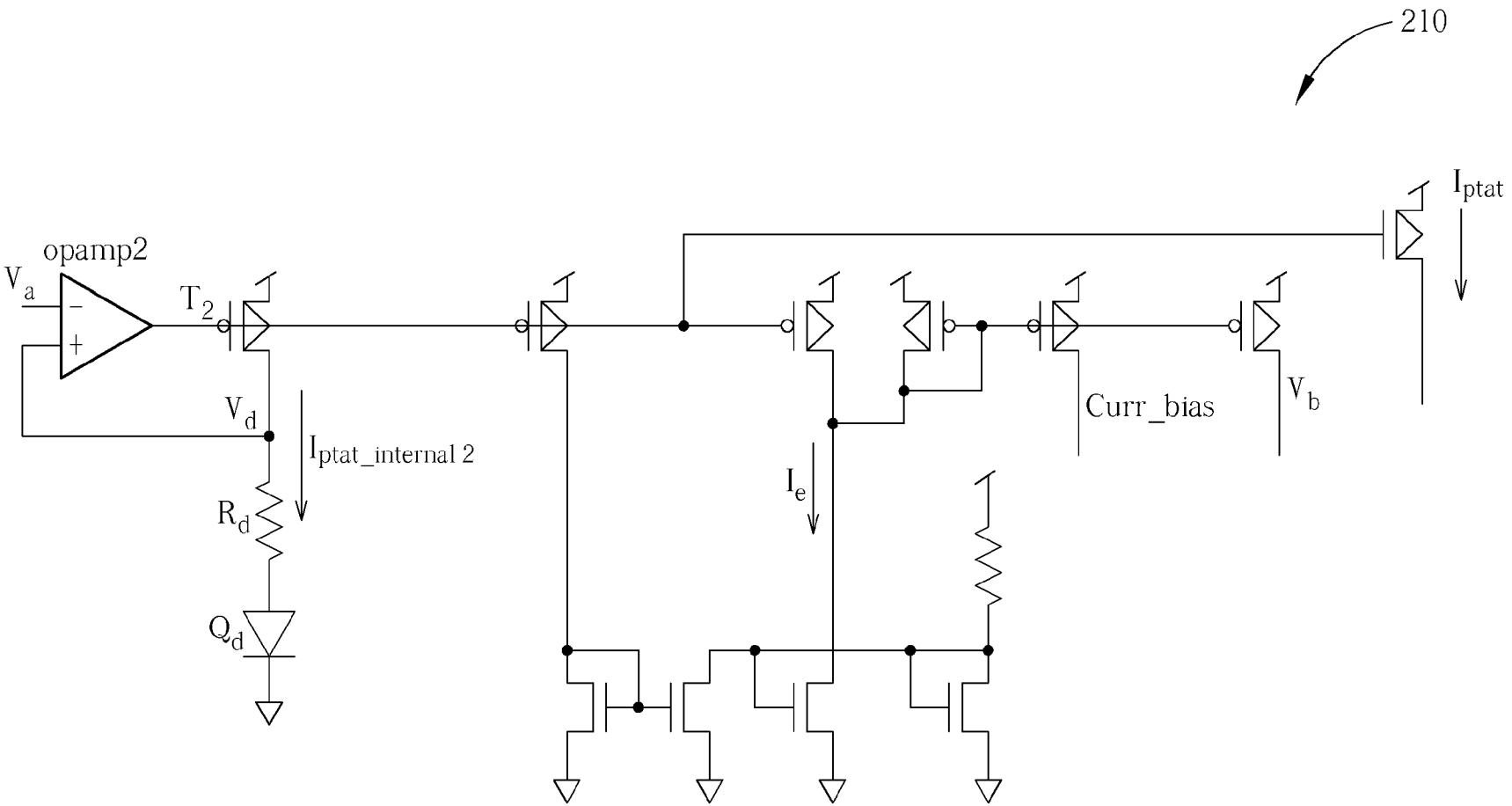
FIG. 4 is an exemplary schematic diagram of a start circuit shown in FIG. 2 according to an embodiment of the present invention.

Turning to the start circuit, FIG. 4 is an exemplary schematic diagram of the start circuit 210 shown in FIG. 2 according to an embodiment of the present invention. The exemplary start circuit 210 comprises a second operational amplifier (op amp) opamp2, a second transistor T2, a second resistor Rd, and a second diode Qd. The second operational amplifier (op amp) includes a positive input, a negative input coupled to the first voltage node Va in the low voltage bandgap 220 (in FIG. 3), and an output. The second transistor T2 has a gate coupled to the output of the second op amp opamp2, and a source coupled to power. The second resistor Rd has one end coupled to the positive input of the second op amp opamp2 (shown in FIG. 4 at node Vd) and to a drain of the second transistor T2, and the other end of the resistor Rd is coupled to the anode of the second diode Qd. The cathode end of the second diode Qd is coupled to ground. Similar to the concept employed in the low voltage bandgap 220, the values of the second resistor Rd and the second diode Qd in the start circuit 210 can be selected to provide a second internal PTAT current Iptat_internal2 flowing through the second resistor Rd and the second diode Qd, such that the second internal PTAT current Iptat_internal2 matches the first internal PTAT current Iptat_internal1.

Please note that the schematic diagram in FIG. 4 is an exemplary selection for illustration purposes only and is not intended as a limitation to the present invention. For instance, numerous other designs and implementations of a start circuit 210 are possible and should be considered within the scope of the present invention, as long as values of the second resistor Rd and the second diode Qd can be selected to create a second internal PTAT current Iptat_internal2 flowing through them.

With a voltage input from the first voltage node Va as the negative input to the second op amp opamp2 and the positive feedback loop provided from the second voltage node Vd, the start circuit 210 generates an output PTAT current Iptat (also shown in FIG. 2) to be summed by the current summer 230 as previously described.

By employing the above embodiments, or other variations that would be clear to a person skilled in the art after reading the above disclosure, the present invention generates a constant with temperature current reference Iconst utilizing a single start circuit 210, one low voltage bandgap 220, and a current summer 230. By removing the necessity of a (second) PTAT current bandgap 140 and a second start circuit 115, the required circuit and layout real estate is reduced. The present invention also enjoys the benefits of greatly reduced power consumption and lower circuit complexity, while retaining high performance and accuracy.

Figure 5:
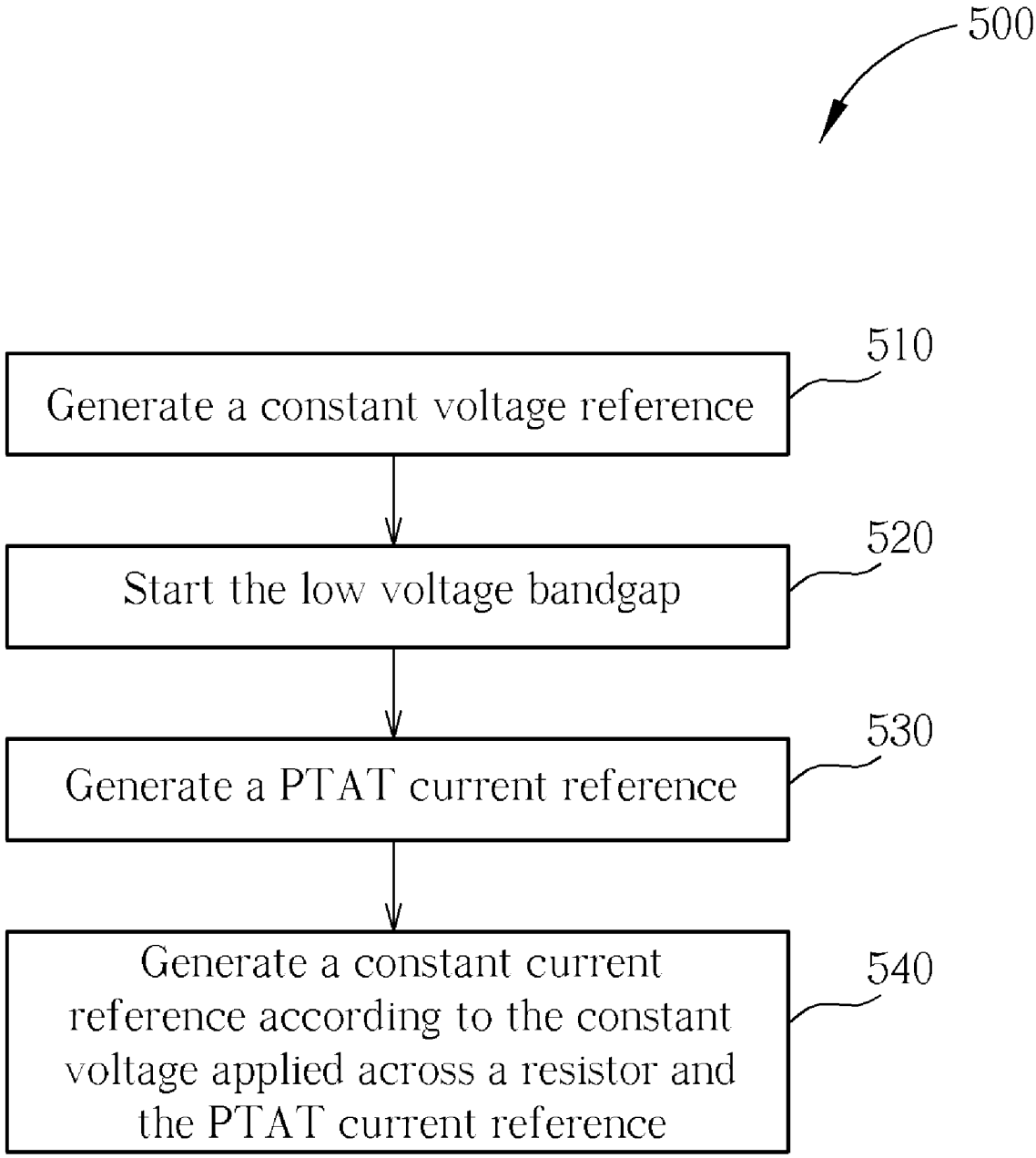
FIG. 5 is a flowchart of a method for providing a low-voltage current reference being substantially constant with temperature, according to an embodiment of the present invention.

Please refer to FIG. 5, which shows a flowchart 500 for a method for providing a low-voltage current reference being substantially constant with temperature, according to an embodiment of the present invention. Provided that substantially the same result is achieved, the steps of the process flowchart need not be in the exact order shown and need not be contiguous; that is, other steps can be intermediate. The embodiment of the method according to the present invention includes the following steps:

Step 510: Generate a constant voltage reference utilizing a low voltage bandgap.

Step 520: Start the low voltage bandgap from a non-start mode utilizing a start circuit.

Step 530: Generate a proportional to absolute temperature (PTAT) current reference utilizing the start circuit.

Step 540: Generate a constant current reference according to the constant voltage reference applied across a resistor (i.e., Icmnres) and the PTAT current reference (i.e., Iptat) utilizing a current summer.

As shown in FIG. 5, the flowchart begins with Step 510, which generates a constant voltage reference Vbgref utilizing a low voltage bandgap 220 (such as the low voltage bandgap 220 shown in FIG. 3). In Step 520, a start circuit 210 coupled to the low voltage bandgap 220 starts the low voltage bandgap 220 from a non-start mode. The start circuit 210 also generates a proportional to absolute temperature (PTAT) current reference Iptat (Step 530). The method then proceeds to Step 540, generating a constant current reference Iconst according to the constant voltage reference Vbgref applied across a resistor and the PTAT current reference Iptat, by utilizing a current summer 230 that is coupled to the low voltage bandgap 220 and to the start circuit 210.

Although the present invention and its advantages have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

For example, in one embodiment of a method according to the present invention, another step is included for selecting values of at least the first resistor R3 and the first diode Q1 connected in series in the low voltage bandgap 220 (for example), such that the current flowing through the first resistor R3 and the first diode Q1 is an internal PTAT current, the first internal PTAT current Iptat_internal1.

In yet another embodiment, a further step (not shown) involves matching a second internal PTAT current Iptat_internal2 within the start circuit 210 to the first internal PTAT current Iptat_internal1 by selecting values of at least the second resistor Rd and the second diode Qd connected in series in the start circuit 210, where one end of the second resistor Rd is connected to the second diode Qd and the other end of the second resistor Rd is coupled to a second voltage node (Vd in FIG. 4).

It should be noted that although the embodiments of the present invention have been mentioned in use for high-accuracy circuits and chips, the application to high-accuracy or sensitive electronic circuits is not a limitation of the scope of this invention. The present invention can be applied to any electronic circuits and such applications and embodiments also obey the spirit of and should be considered with the scope of the present invention.

After reviewing this first embodiment of the present invention, other applications and implementations will be obvious to those skilled in the art, and should be included within the scope of the present invention. Similar applications encompassed and alluded to by the present invention for reducing the number of components (such as the start circuit 115 and the PTAT current bandgap 140) should also be considered inside the scope of the present invention.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

Those skilled in the art will readily observe that numerous modifications and alterations of the device and method may be made while retaining the teachings of the invention.

What is claimed is:

1. A low-voltage current reference providing a current being substantially constant with temperature, the low-voltage current reference comprising:

a low voltage bandgap, for providing a constant voltage reference;

a start circuit coupled to the low voltage bandgap, for starting the low voltage bandgap from a non-start mode and for providing a proportional to absolute temperature (PTAT) current reference; and a current summer coupled to the low voltage bandgap and to the start circuit, for providing a constant current reference according to the constant voltage reference and the PTAT current reference;

wherein within the low voltage bandgap, values of at least a first resistor and a first diode connected in series are selected to provide a first internal PTAT current flowing through at least the first resistor and the first diode, the first resistor has one end connected to the first diode and having another end coupled to a first voltage node; and the start circuit comprises:

a first operational amplifier (op amp) having a positive input, a negative input coupled to the first voltage node, and an output;

a second transistor having a gate coupled to the output of the first op amp, and a source coupled to power; and a circuit, coupled to the second transistor, wherein a second internal PTAT current flows through the circuit.

2. The low-voltage current reference of claim 1, further comprising a current mirror having an input coupled to an output of the current summer, for mirroring the constant current reference to thereby provide a plurality of output currents.

3. The low-voltage current reference of claim 1, wherein the low voltage bandgap further comprises:

a second operational amplifier (op amp) having a positive input, a negative input, and an output;

a first transistor having a gate coupled to the output of the second op amp, and a source coupled to power;

the first resistor having a first end coupled to the positive input of the second op amp and to a drain of the first transistor;

the first diode having an anode coupled to a second end of the first resistor and a cathode end coupled to ground; and a third resistor coupled between the first end of the first resistor and ground;

wherein the first internal PTAT current flows through the first resistor and the first diode.

4. The low-voltage current reference of claim 1, wherein the circuit comprises at least a second resistor and a second diode connected in series, and values of at least the second resistor and the second diode are selected to provide the second internal PTAT current matching the first internal PTAT current, the second resistor having one end connected to the second diode and having another end coupled to a second voltage node.

5. The low-voltage current reference of claim 4, wherein the second resistor having a first end coupled to the positive input of the first op amp and to a drain of the second transistor; and the second diode having an anode coupled to a second end of the second resistor and a cathode end coupled to ground.

6. A method for providing a low-voltage current reference being substantially constant with temperature, the method comprising:

generating a constant voltage reference utilizing a low voltage bandgap;

starting the low voltage bandgap from a non-start mode utilizing a start circuit coupled to the low voltage bandgap;

generating a proportional to absolute temperature (PTAT) current reference utilizing the start circuit;

generating a constant current reference according to the constant voltage reference and the PTAT current reference utilizing a current summer coupled to the low voltage bandgap and to the start circuit;

selecting values of at least a first resistor and a first diode connected in series in the low voltage bandgap to thereby provide a first internal PTAT current flowing through at least the first resistor and the first diode, the first resistor having one end connected to the first diode and having another end coupled to a first voltage node;

providing a first operational amplifier (op amp) in the start circuit having a positive input, a negative input coupled to the first voltage node, and an output;

providing a second transistor in the start circuit having a gate coupled to the output of the first op amp, and a source coupled to power;

providing a circuit in the start circuit, wherein the circuit is coupled to the first op amp and the second transistor, and the second internal PTAT current is a current flowing through the circuit.

7. The method of claim 6, further comprising mirroring the constant current reference to thereby provide a plurality of output currents.

8. The method of claim 7, further comprising:

providing a second operational amplifier (op amp) in the low voltage bandgap having a positive input, a negative input, and an output;

providing a first transistor in the low voltage bandgap having a gate coupled to the output of the second op amp, and a source coupled to power;

providing the first resistor in the low voltage bandgap having a first end coupled to the positive input of the first op amp and to a drain of the first transistor;

providing the first diode in the low voltage bandgap having an anode coupled to a second end of the first resistor and a cathode end coupled to ground; and providing a third resistor in the low voltage bandgap coupled between the first end of the first resistor and ground;

wherein the first internal PTAT current is a current flowing through the first resistor and the first diode.

9. The method of claim 7, wherein the circuit comprises at least a second resistor and a second diode connected in series, and the method further comprises matching a second internal PTAT current within the start circuit to the first internal PTAT current by selecting values of at least the second resistor and the second diode connected in series in the start circuit, the second resistor having one end connected to the second diode and having another end coupled to a second voltage node.

10. The method of claim 9, further comprising:

providing the second resistor in the start circuit having a first end coupled to the positive input of the second op amp and to a drain of the second transistor; and providing the second diode having an anode coupled to a second end of the second resistor and a cathode end coupled to ground.

* * * * *